US007398815B2

(12) United States Patent
Liang

(10) Patent No.: US 7,398,815 B2
(45) Date of Patent: Jul. 15, 2008

(54) NON-PULL CORD OPERATED WINDOW BLIND STRUCTURE

(75) Inventor: Wen Ying Liang, Changhua Hsien (TW)

(73) Assignee: Ching Feng Home Fashions Co., Ltd., Changhua Hsien (TW)

( * ) Notice: Subject to any disclaimer, the term of this patent is extended or adjusted under 35 U.S.C. 154(b) by 148 days.

(21) Appl. No.: 11/344,237

(22) Filed: Feb. 1, 2006

(65) Prior Publication Data

US 2007/0125505 A1 Jun. 7, 2007

(30) Foreign Application Priority Data

Dec. 7, 2005 (TW) ..... 94221282 U

(51) Int. Cl.
*E06B 9/30* (2006.01)

(52) U.S. Cl. ..... 160/170; 160/84.05

(58) Field of Classification Search ..... 160/170, 160/171, 84.01, 84.04, 84.05, 168.1 R, 173 R, 160/178.1 R, 172; 242/372
See application file for complete search history.

(56) References Cited

U.S. PATENT DOCUMENTS 6,305,632 B1 * 10/2001 Hwang ..... 242/378.1
7,168,476 B2 * 1/2007 Chen ..... 160/170
2004/0154758 A1 * 8/2004 Cheng et al. ..... 160/170
2007/0119547 A1 * 5/2007 Liang ..... 160/170
2007/0151675 A1 * 7/2007 Nien et al. ..... 160/84.05

FOREIGN PATENT DOCUMENTS

WO WO9209779 A1 * 6/1992

* cited by examiner

*Primary Examiner*—Blair M. Johnson
(74) *Attorney, Agent, or Firm*—Troxell Law Office, PLLC

(57) ABSTRACT

A non-pull cord operated window blind structure comprises a head rail with a blind body attached to the underside and actuated by a collecting cord wherein a cord-winding control device actuated by an operating cord, and a fixed seat are respectively mounted at both ends of the head rail with a movable seat situated there-between. One end of the operating cord is attached to the movable seat, and both ends of the collecting cord are synchronically wound through the fixed seat and the movable seat and located at the fixed seat, permitting the operating cord and the collecting cord to associate with each other in linking operation. Therefore, a bottom rail is simply pushed or pulled by hands to loosen or tighten the collecting cord and actuate the operating cord therewith, permitting a state of counterbalance formed there-between for easy adjustment of the blind body into a desirable position thereby.

6 Claims, 4 Drawing Sheets

NON-PULL CORD OPERATED WINDOW BLIND STRUCTURE

BACKGROUND OF THE INVENTION

The present invention relates to a non-pull cord operated window blind structure, comprising a head rail with a blind body attached to the underside and actuated by a collecting cord wherein both ends of the head rail have a cord-winding control device with an operating cord linked thereto and a fixed seat respectively mounted thereto with a movable seat situated there-between; whereby, the operating cord and the collecting cord are reciprocally associated with each other in linking operation so that a bottom rail is simply pushed or pulled by hands to loosen or tighten the collecting cord wound onto the movable seat and actuate the operating cord therewith, permitting a counterbalance formed there-between for easy adjustment of the blind body into a desirable position thereby.

A conventional window blind structure is usually made up of a blind body, an operating drive assembly, and a pull cord. In operation, the pull cord is drawn by force exerted by the hand of a user, and the small frictional surface of the pull cord tends to rub against the hand exerting force thereon and, thus, leave strained marks on the contact area of the hand thereof. Besides, in case of an excessive down-pulling force exerted onto the pull cord or a sudden release at great speed, the blind body cannot be accurately positioned in a desirable position and the adjustment process must be repeated over again, which is quite inconvenient in operation.

SUMMARY OF THE PRESENT INVENTION

It is, therefore, the primary purpose of the present invention to provide a non-pull cord operated window blind structure wherein pushing or pulling force is exerted by hands of a user to cooperatively work with the elasticity generated by torsion springs mounted to a cord-winding control device so that a blind body can be easily adjusted into a desirable position, avoiding unnecessary injury like the strained marks left on the hand by the conventional pulling cord so as to achieve the best application state of the present invention.

It is, therefore, the second purpose of the present invention to provide a non-pull cord operated window blind structure wherein pushing or pulling force is exerted by the hands of a user to cooperatively work with the elasticity generated by the torsion springs of the cord-winding control device, permitting the blind body to precisely locate in place as pulled or pushed by the hand of the user in the expanding or collecting operation thereof, speedily adjusting the blind body into a desirable position without the inconvenience shown in the conventional pull cord thereof to achieve an accuracy and simplicity in operation as well as in assembly thereby.

It is, therefore, the third purpose of the present invention to provide a non-pull cord operated window blind structure wherein a movable seat and a fixed seat are respectively provided with a winding cavity and a winding groove with gliding elements and sliding elements disposed thereon for the winding of a collecting cord thereon in a sequence to achieve separation and positioning guide purposes thereby so that the blind body can be smoothly expanded or collected without the collecting cord being entangled in the operation thereof, achieving the best application state of the present invention thereby.

DETAILED DESCRIPTION OF THE PREFERRED EMBODIMENTS

Figure 1:
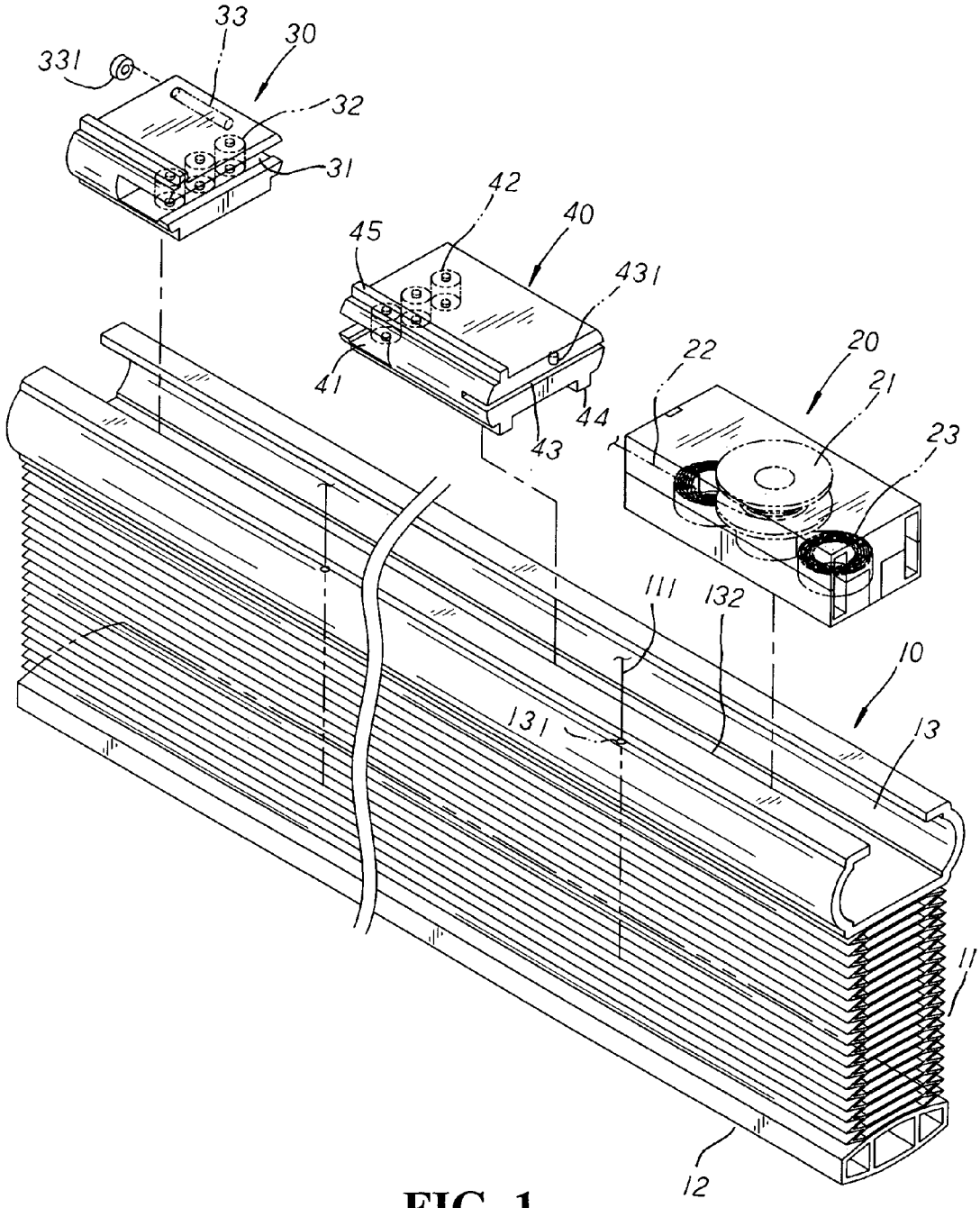
FIG. 1 is an exploded perspective view of the present invention.

Please refer to FIG. 1 showing an exploded perspective view of the present invention. The present invention relates to a non-pull cord operated window blind structure, comprising a head rail 10, a blind body 11 attached to the underside of the head rail 10, and a bottom rail 12 wherein the blind body 11 and the bottom rail 12 are synchronically actuated by a collecting cord 111. An accommodating channel 13 with cord-passing holes 131 disposed thereon is provided defining the top surface of the head rail 10 thereon for the mounting of a cord-winding control device 20 and a fixed seat 30 at both ends therein respectively, and a movable seat 40 is situated between the cord-winding control device 20 and the fixed seat 30 thereof. The cord-winding control device 20 has a rotary seat 21 disposed at the interior therein, and an operating cord 22 is attached to the rotary seat 21 at one end thereof. The rotary seat 21 has a lower end with a set of torsion springs 23 symmetrically linked to both lateral sides thereon. Both torsion springs 23 can be synchronically actuated by the operating cord 22 and the rotary seat 21 revolving in clockwise or counterclockwise rotation to counter wind or recoil and then elastically locate thereby. The fixed seat 30 and the movable seat 40 are respectively provided with a transversely U-shaped winding groove 31 and a transversely U-shaped winding cavity 41 symmetrically disposed at the corresponding lateral side thereon. And both winding groove 31 and the winding cavity 41 have a plurality of sliding elements 32 and gliding elements 42 vertically arranged at the interior thereon respectively wherein two or more than two sets of the sliding and gliding elements 32, 42 can be provided respectively depending on the length of the collecting cord 111 thereof. The other lateral side of the fixed seat 30 is disposed a cord-passage 33 to communicate with the winding groove 31 thereof, and a ringed-shaped buckling element 331 is provided to match to the cord-passage 33 therewith. The other lateral side of the movable seat 40 has a restricting cavity 43 defining thereon, and a vertical positioning rod 431 is disposed extending in the restricting cavity 43 thereon. The movable seat 40 also includes a plurality of support legs 44 protruding at the bottom section thereon to abut against the inner surface of the accommodating channel 13 thereby, and a guide rib 45 extending at the upper edge thereon in abutting contact with an opening edge 132 of the accommodating channel 13 of the head rail 10 thereby.

Figure 2:
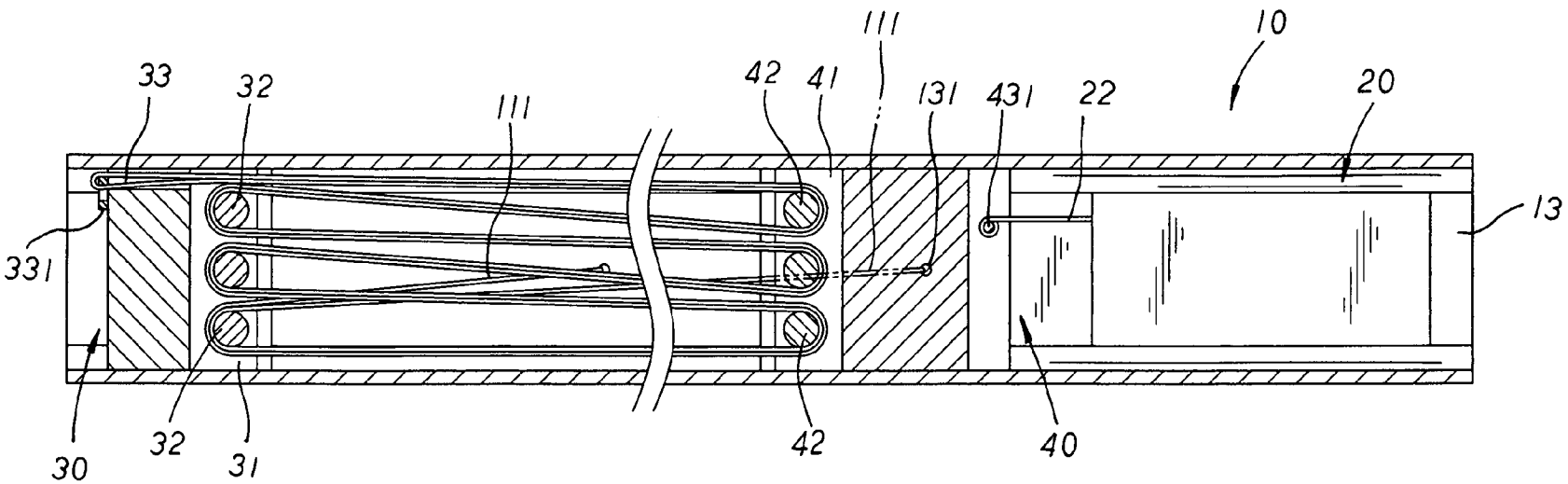
FIG. 2 is an assembled cross sectional view of the present invention.

Please refer to FIG. 2 showing an assembled cross sectional view of the present invention. In assembly, one collecting cord 111 is wound around the buckling element 331, and both ends of the collecting cord 11 are aligned in equal length and synchronically guided to extend through the cord-passage 33 and the winding groove 31 of the fixed seat 30 in a sequence. Then, the collecting cord 111 is continuously extended to run back and forth through the winding cavity 41 of the movable seat 40 and then the winding groove 31 of the fixed seat 30 in a series and wind in consecutive S shape onto each sliding and gliding element 32, 42 sequentially, permitting the buckling element 331 to precisely contact with the cord-passage 33 in abutting location and form a positioning end thereby. Finally, both ends of the collecting cord are respectively guided to thread through the cord-passing holes 131 of the head rail 10 and led downwards to pass through the blind body 11 till fixed to the bottom rail 12 at the bottommost ends thereof. The other end of the operating cord 22 linked to the cord-winding control device 20 at one end thereof is then guided to run through the restricting cavity 43 of the movable seat 40 and fixedly attach to the positioning rod 431 thereon, permitting the operating cord 22 and the collecting cord 11 to associate with each other in linking operation and reciprocally actuate the movable seat 40 thereby to complete the assembly of the present invention.

Figure 3:
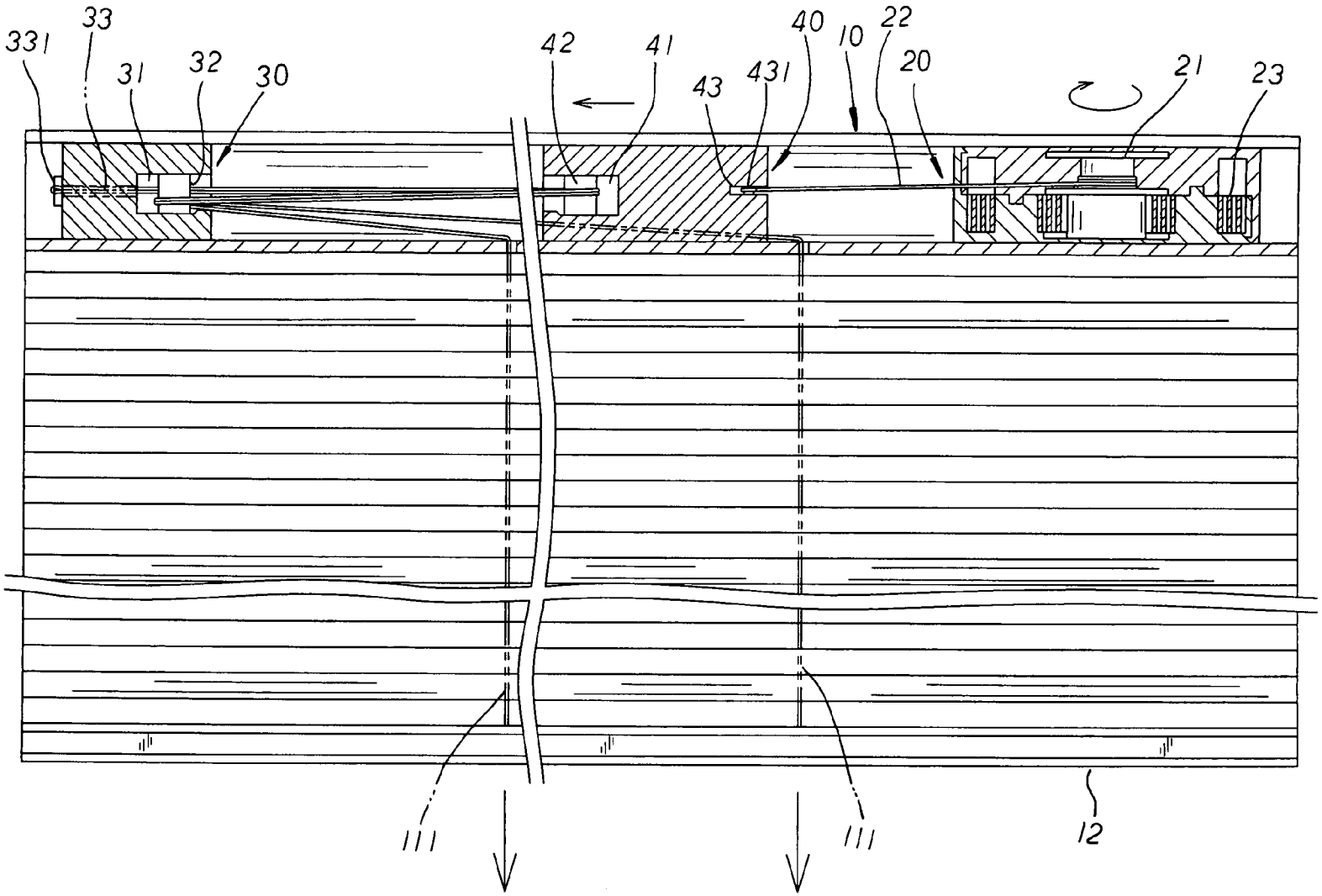
FIG. 3 is a diagram showing a blind body of the present invention operated to expand downward in application.

In application, when the blind body 11 as shown in FIG. 3 is to be expanded downwards, force is exerted by hands to pull down the bottom rail 12, permitting one end of the collecting cord 111 affected by the movement of the bottom rail 12 to run along the gliding and sliding elements 42, 32 of the movable seat 40 and the fixed seat 30 respectively and stretch downwards through the cord-passing holes 131 thereof. Meanwhile, the support legs 44 and the guide rib 45 of the movable seat 40 will be actuated by the downwards-stretched collecting cord 111 to slide along the accommodating channel 13 and the opening edge 132 of the head rail 10 and approach towards the fixed seat 30 in linking operation. Then, the operating cord 22 will be drawn accordingly to synchronically actuate the rotary seat 21 of the cord-winding control device 20 revolving in clockwise rotation therewith, and the two torsion springs 23 symmetrically juxtaposed at both lateral sides of the rotary seat 21 to augment the elasticity thereby are affected by the pulling forcing to revolve counterclockwise in an S shape rotation with a constant torque naturally occurred to counter wind and collect tight onto the rotary seat 21 thereby. Furthermore, the constant torque occurred works in a linear operation and the torque will not be altered due to the increase of the coils counter wound thereon, reinforcing the strengthen of the blind body 11 affected by the pulling force to achieve efficient suspension thereby.

Figure 4:
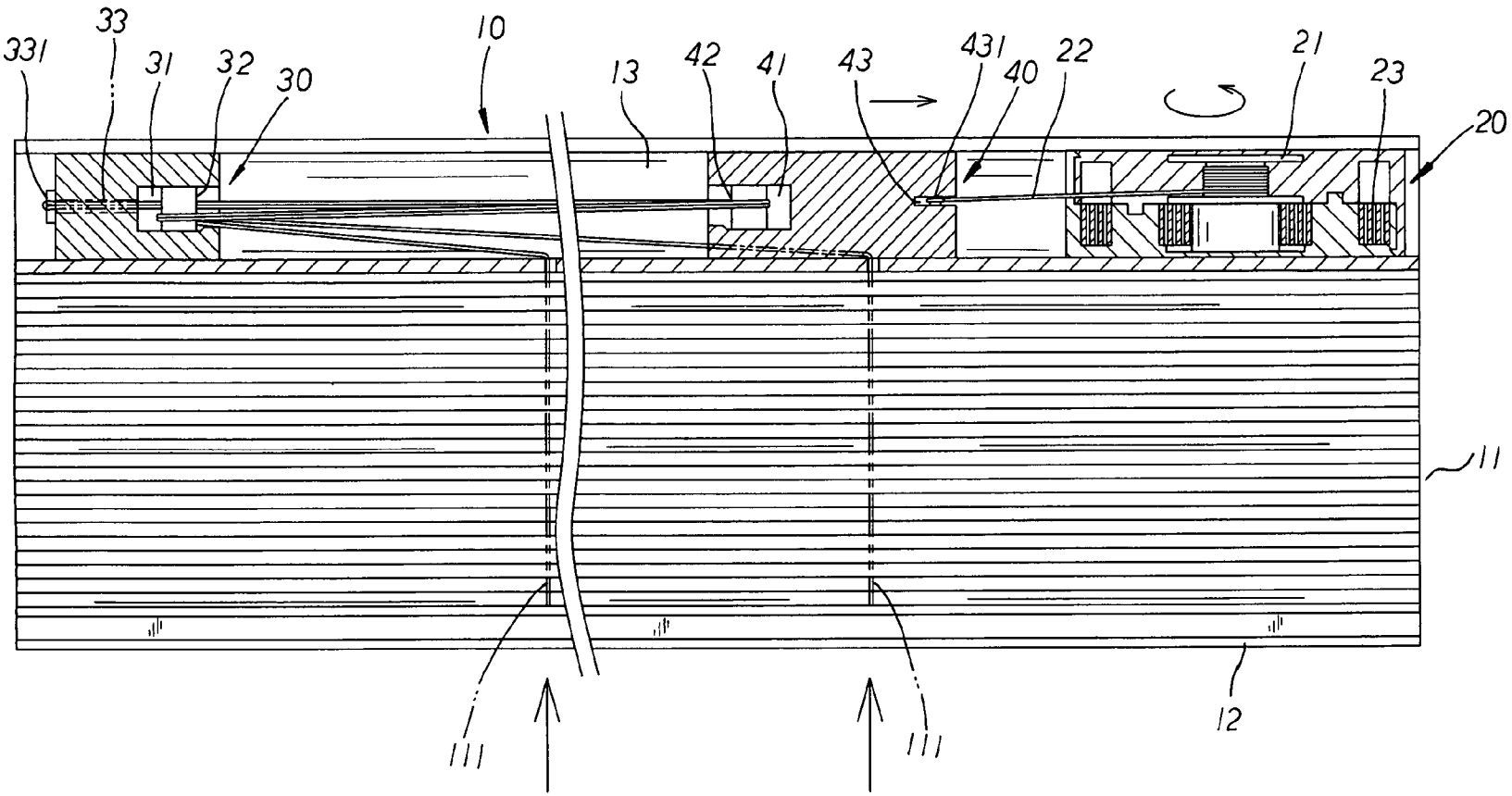
FIG. 4 is a diagram showing the blind body of the present invention operated to collect upwards in application.

When the blind body 11 as shown in FIG. 4, is to be collected upwards, the bottom rail 12 is pushed upwards by the hands, and the counter-wound torsion springs 23 will be released to naturally recoil backwards, permitting the rotary seat 21 to revolve in counterclockwise rotation with a certain torque occurred at the same time. Then, the movable seat 40 will be freed from the pulling force of the collecting cord 111 loosened by the uplift bottom rail 12 thereof, and actuated by the pulling force of the retrieving operating cord 22 to slide towards the cord-winding control device 20 thereby. Meanwhile, the collecting cord 111 will be synchronically drawn by the sliding movable seat 40 to run smoothly around the gliding and sliding elements 42, 32 and retrieve upwards through the cord-passing holes 131 thereof to collect the blind body 11 thereby. Therefore, via the pushing and pulling forces exerted by the hands to actuate the cord-winding control device 20 with constant torque occurred thereby in linking operation, the present invention can avoid the injury like strained marks left on the hands by the above-mentioned conventional pull cord thereof so that the blind body 11 can be easily adjusted into a desirable position, achieving the best application state thereby. In addition, the movable seat 40 and the fixed seat 30 are respectively equipped with the winding cavity 41 and the winding groove 31 for multiple gliding and sliding elements 52, 42 to mount therein so that the collecting cord 111 can be wound thereon sequentially to achieve separation and positioning guide purposes thereby. Thus, the blind body 11 can be easily and smoothly expanded and collected without the collecting cord 111 being entangled in operation.

Furthermore, depending on the number of the cords applied, the collecting cord 111 can also be wound upwards from the bottom rail 12 thereof. In this case, the collecting cords 111 are guided upwards to pass through the blind body 11 and the cord-passing holes 131 of the head rail 10 respectively before synchronically extended to run through the winding cavity 41 and the winding groove 31 of the movable seat 40 and the fixed seat 30 and wind onto each gliding and sliding element 42, 32 in a sequence. Then, the collecting cords 111 are synchronically guided through the cord-passage 33 of the fixed seat 30 and attached to the buckling element 331 to form a fixed end thereby.

What is claimed is:

1. A non-pull cord operated window blind structure comprising: a head rail, a blind body attached to the underside of the head rail, and a bottom rail wherein the blind body and the bottom rail are synchronically actuated by a collecting cord; both ends of the head rail have a cord-winding control device with an operating cord connected thereto, and a fixed seat respectively mounted therein with a movable seat situated there-between; the other end of the operating cord is attached to the movable seat thereof, and both ends of the collecting cord are synchronically wound through the fixed seat and the movable seat at both ends and located at the fixed seat at one side, permitting the operating cord of the cord-winding control device and the collecting cord wound onto the movable seat and the fixed seat to reciprocally associate with each other in linking operation; therefore, pushing or pulling force is exerted by hands onto the bottom rail to loosen or tighten the collecting cord wound onto the movable seat, and actuate the movement of the operating cord therewith, permitting a state of counterbalance formed there-between so that the blind body is easily and smoothly adjusted into a desirable collected or expanded Position thereby, wherein the fixed seat and the movable seat are respectively provided with a winding groove and a winding cavity dispose at the corresponding lateral side thereon, and multiple vertical sliding elements and gliding elements are respectively arranged at the winding groove and the winding cavity thereon for the winding of the collecting cord thereon; the other lateral side of the fixed seat is disposed a cord-passage communicating with the winding groove thereof and matched to a buckling element for the location of the collecting cord thereby; the other lateral side of the movable seat has a restricting cavity defining thereon, and a vertical positioning rod is disposed extending in the restricting cavity thereon for the attachment of the operating cord thereto.

2. The non-pull cord operated window blind structure as claimed in claim 1 wherein a top surface of the head rail is defined by an accommodating channel having cord-passing holes disposed therein.

3. The non-pull cord operated window blind structure as claimed in claim 1 wherein the cord-winding control device has a rotary seat disposed at the interior therein for one end of the operating cord to attach thereto, and a set of torsion springs symmetrically connected to both lateral sides of the lower end thereon; both torsion springs can be synchronically actuated by the movement of the operating cord and the clockwise or counterclockwise revolving of the rotary seat to counter wind or recoil and elastically locate thereby.

4. The non-pull cord operated window blind structure as claimed in claim 1 wherein the buckling element is formed in a ringed shape.

5. The non-pull cord operated window blind structure as claimed in claim 1 wherein the winding groove of the fixed seat and the winding cavity of the movable seat are correspondingly made in a transverse U shape.

6. The non-pull cord operated window blind structure as claimed in claim 1 wherein the movable seat is equipped with support legs protruding at the bottom section thereon, and a guide rib extending at the upper section thereon.

* * * * *